US007001318B2

(12) United States Patent
Su-Tuan

(10) Patent No.: US 7,001,318 B2
(45) Date of Patent: Feb. 21, 2006

(54) COLORFUL EXERCISE MAT WITH TOTEM PATTERNS

(76) Inventor: Hsu Tang Su-Tuan, 3F-1, No. 123, Sec. 2, Cheng Kung Rd., Tao Yuan City, Tao Yuan Hsien (TW)

( * ) Notice: Subject to any disclaimer, the term of this patent is extended or adjusted under 35 U.S.C. 154(b) by 0 days.

(21) Appl. No.: 10/838,347

(22) Filed: May 5, 2004

(65) Prior Publication Data

US 2005/0250631 A1 Nov. 10, 2005

(51) Int. Cl.
*A63B 71/00* (2006.01)

(52) U.S. Cl. ..... 482/148; 482/23; 5/420

(58) Field of Classification Search ..... 482/148, 482/23; 5/420, 417, 465, 481; 36/71; 4/581; D06/582; 15/215; 52/660; D12/203; 446/85, 446/116, 127

See application file for complete search history.

(56) References Cited

U.S. PATENT DOCUMENTS 3,047,888 A * 8/1962 Shecter et al. ..... 428/218
3,118,153 A * 1/1964 Hood ..... 428/218
3,889,032 A * 6/1975 Koelsch ..... 428/218
4,450,193 A * 5/1984 Staebler ..... 428/71
4,934,024 A * 6/1990 Sexton, I ..... 16/421
5,212,842 A * 5/1993 Glydon ..... 5/420
5,562,573 A * 10/1996 Harinishi ..... 482/23
5,820,445 A * 10/1998 Smith et al. ..... 450/86
6,036,902 A * 3/2000 Wang ..... 264/132
6,159,583 A * 12/2000 Calkins ..... 428/195.1
6,352,769 B1 * 3/2002 Mori ..... 428/354
6,663,537 B1 * 12/2003 McCoy ..... 482/23
2002/0166468 A1 * 11/2002 Schmid et al. ..... 101/127

* cited by examiner

*Primary Examiner*—Gregory L. Huson
*Assistant Examiner*—L. Amerson
(74) *Attorney, Agent, or Firm*—Troxell Law Office, PLLC

(57) ABSTRACT

An exercise mat with totem patterns formed by the following steps: soaking a mesh substrate in a non-slip paste including a pigment; foaming the non-slip paste to combine the non-slip paste with the mesh substrate to form a mat and; printing totem patterns, formed from PU material, on the mat using mesh-printing process. The present exercise mat provides a smoother section and a rougher section for the choice of users.

5 Claims, 3 Drawing Sheets

COLORFUL EXERCISE MAT WITH TOTEM PATTERNS

BACKGROUND OF THE INVENTION

1. Field of the Invention

The present invention relates to a colorful exercise mat with totem patterns, and more particularly to a colorful exercise mat with totem patterns, which is not easy to discolor.

2. Description of the Prior Art

More and more people do exercise at home. Generally, for avoid slipping or getting hurt when slipping or falling down to hit the hard ground, people use exercise mats for cushion. For example, when people do yoga, they use exercise mats.

However, the conventional exercise mat is monochromatic and monotone. Even though spraying is used to form color on the conventional exercise mat, it is easy to discolor for the conventional exercise mat.

In order to resolve the above problem, an improved exercise mat is disclosed in the present invention.

SUMMARY OF THE INVENTION

The present invention provides a colorful exercise mat with totem patterns. The present exercise mat includes a substrate and a repeated totem patterns formed thereon. It is not easy for the present exercise mat to discolor. Meanwhile, the present exercise mat provides the smoother section and rougher section for the choice of users.

The present exercise mat can be divided into 6 sections. The totem patterns are formed on the central 4 sections. In this way, users can choose to do exercise on the central 4 sections where is smoother, or on the rougher sections of the two sides.

The present exercise mat is formed by the following steps, including: soaking a mesh-like substrate in non-slip paste; adding pigment to the non-slip paste; foaming the non-slip paste to combine the non-slip paste with the mesh-like substrate to form a mat and; printing totem patterns, formed from PU material, on the mat using mesh-printing process.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
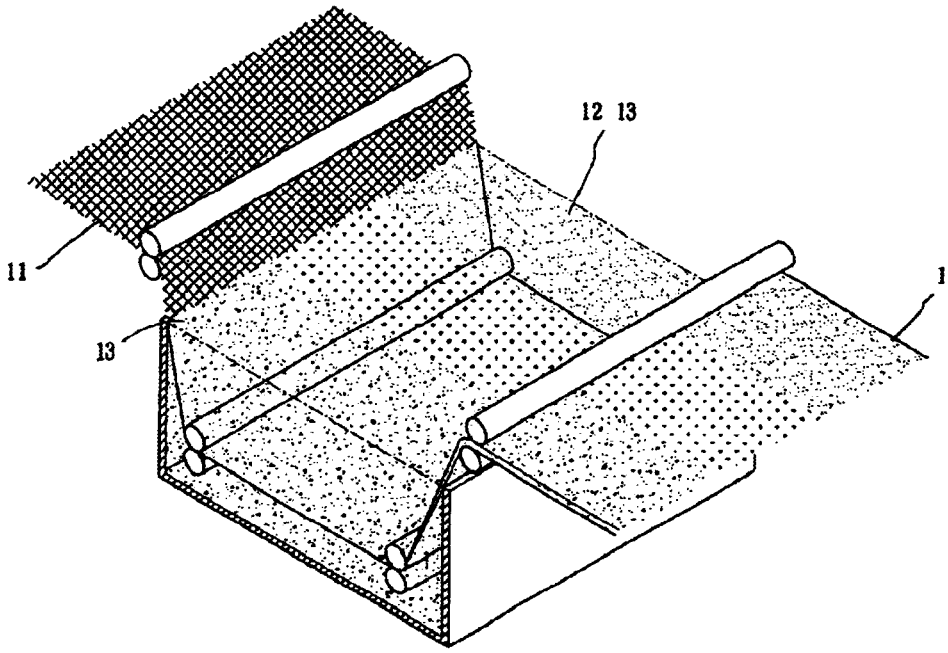
FIG. 1 depicting the method of the present invention.
Figure 2:
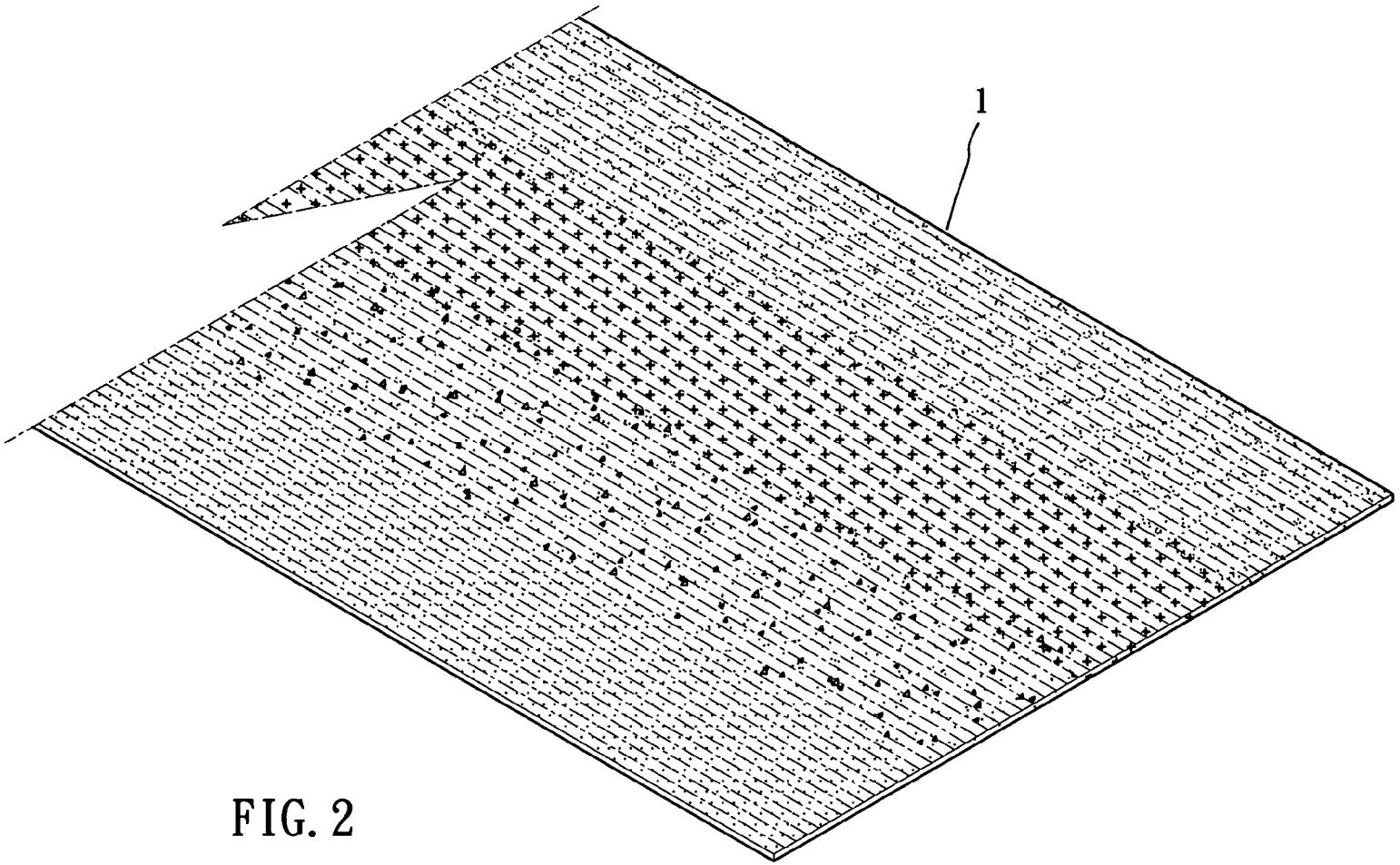
FIG. 2 depicting the perspective view of the present invention.
Figure 3:
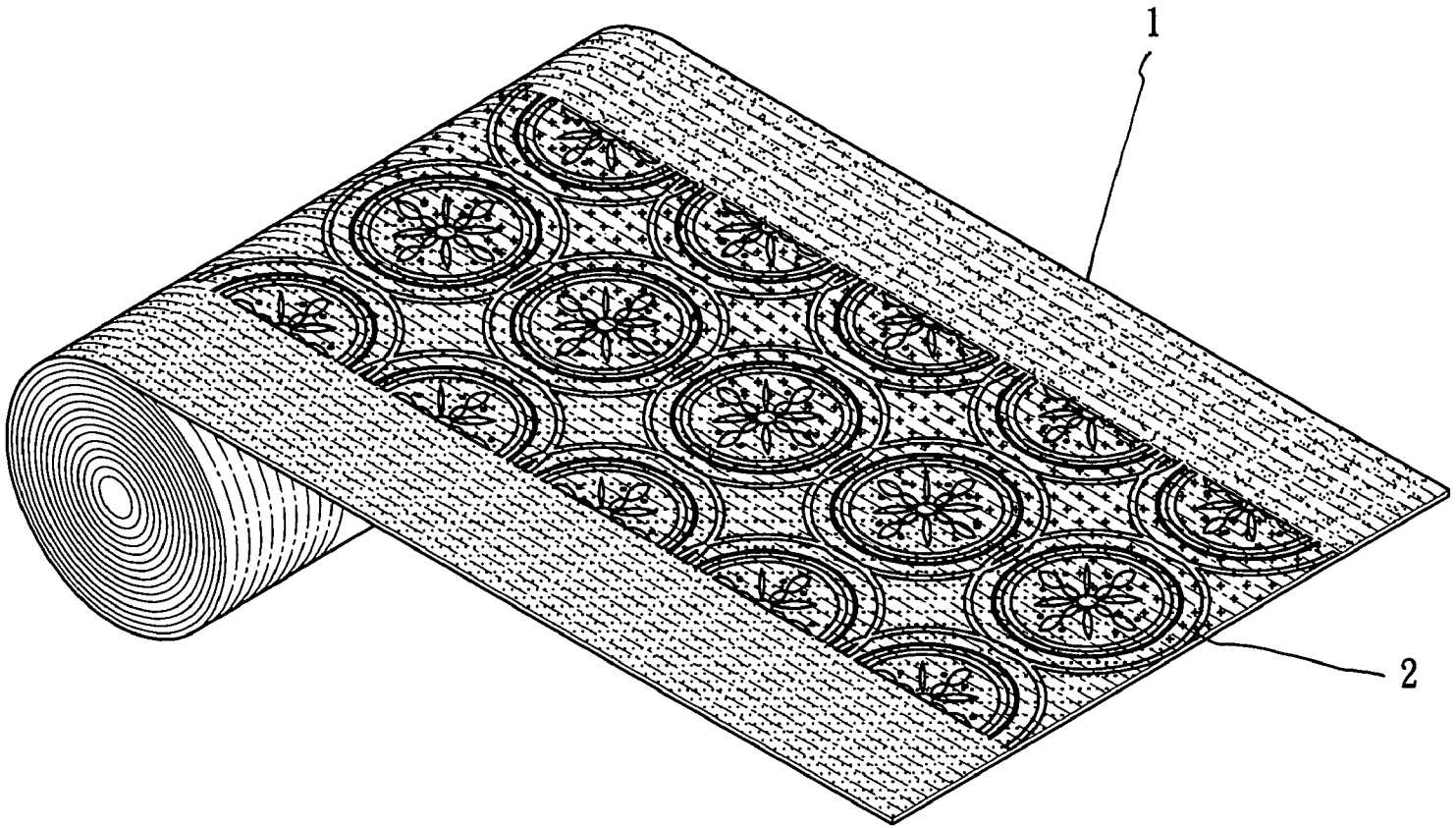
FIG. 3 depicting another perspective view of the present invention.

Referring to FIG. 1 through FIG. 3, the present invention provides a colorful exercise mat with totem patterns. The present exercise mat includes a substrate 1 and a repeated totem patterns 2 formed thereon.

Referring to FIG. 1 through FIG. 2, the substrate 1 is formed from a mesh-like material 11 and non-slip paste 12. The mesh-like material 11 can be chosen from the net made from any kind of soft strings. Before cooling down, the non-slip paste 12 is the a paste material and can include a PVC material. First, PVC material is melted. Then, a sticky material is added into and combined with the melted PVC material to form the non-slip paste 12. Further, the non-slip paste 12 may include plastic powder, acetic tri bulty citrte, stabilizer and foaming agent.

The substrate 1 is formed with the following steps. First, adding different pigments 13 into a container holding the non-clip paste 12. In this step, the stickiness of the non-slip paste 12 prevents the different pigments 13 from diffusing and combining with each other. Then, using roller to carry the mesh-like material 11 passing through the container slowly. Thus, the mesh-like material 11 is covered with the non-slip paste 12 having the pigments 13 formed thereon. After the foaming, shaping and drying, the colorful substrate 1 having separated color areas is formed.

Besides PVC material mentioned above, environmental-friendly resin (PER) is also suitable for the non-slip paste 12. The PER has the same effect as the PVC made by the conventional method and therefore is non-slip, waterproof and sun-protective. In addition, the present PER is non-pollution and will not emit the gas harmful to the human body even undergoing burning or sunshine. Even undergoing burning at the high temperature of 1200° C., the present PER merely emit $CO_2$, $H_2O$ and little amount of chlorine (Cl), even less than the quantity contained in the daily-used piped water. Therefore, the present method can replace the PVC made by the conventional method and be used to fabricate any product made from PVC. The product made by the present method will not emit the gas harmful to the human body even undergoing burning or sunshine, which meets the environmental-friendly requirement.

Referring to FIG. 3, using a mesh-printing process to print totem patterns 2 with a polyurethane material (PU) on the substrate 1 having separated color areas to form the totem patterns 2.

In the preferred embodiment, the substrate 1 having separated color areas can be divided into 6 sections. The totem patterns 2 are formed on the central 4 sections. In this way, users can choose to do exercise on the central 4 sections where is smoother, or on the rougher sections of the two sides. Further, there are isolation between the totem patterns 2 and the substrate 1.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A method for forming an exercise mat, comprising the following steps:

a) adding pigment to a non-slip paste;

b) coating mesh substrate with the non-slip paste;

c) forming a mat by foaming the non-slip paste to secure the mesh substrate within a foamed non-slip paste; and d) printing totem patterns on the mat using a mesh-printing process, the totem patterns being made from polyurethane.

2. The method according to claim 1, wherein said mesh substrate is made from a PVC material.

3. The method according to claim 1, wherein said mesh substrate is made from a resin material.

4. The method according to claim 1, wherein said mesh substrate and said totem patterns are isolated.

5. The method according to claim 1, wherein said mesh substrate is divided into six sections, wherein said totem patterns are printed on four central 4 sections of the six sections.

* * * * *